US011653775B1

(12) United States Patent
Rutta et al.

(10) Patent No.: US 11,653,775 B1
(45) Date of Patent: May 23, 2023

(54) WIG STAND SYSTEM AND METHOD OF USE

(71) Applicants: Efraim Rutta, Monsey, NY (US); Ruth Toporowitz, Monsey, NY (US)

(72) Inventors: Efraim Rutta, Monsey, NY (US); Ruth Toporowitz, Monsey, NY (US)

( * ) Notice: Subject to any disclaimer, the term of this patent is extended or adjusted under 35 U.S.C. 154(b) by 0 days.

(21) Appl. No.: 17/000,690

(22) Filed: Aug. 24, 2020

(51) Int. Cl.

| | |
|---|---|
| ***A47F 7/06*** | (2006.01) |
| ***A47F 5/02*** | (2006.01) |
| ***A47F 5/05*** | (2006.01) |
| ***A47F 5/01*** | (2006.01) |
| ***A47F 5/10*** | (2006.01) |
| ***A47G 25/10*** | (2006.01) |

(52) U.S. Cl.
CPC ..... *A47F 7/065* (2013.01); *A47F 5/01* (2013.01); *A47F 5/02* (2013.01); *A47F 5/05* (2013.01); *A47F 5/106* (2013.01); *A47G 25/10* (2013.01)

(58) Field of Classification Search
CPC .... A47F 7/065; A47F 8/00; A47F 8/02; A47F 5/01; A47F 5/14; A47F 5/106; A47F 5/0087; A47F 7/06; A47F 5/02; A47F 5/025; A47F 5/04; A47F 5/05; A47F 5/06; A47F 5/10; A47B 61/04; A47B 49/00; A47G 25/10; A47C 7/64; A45D 44/14
USPC ..... 211/78, 165, 163, 30, 33, 85.23, 181.1; 248/153, 175, 176.1; D28/93
See application file for complete search history.

(56) References Cited

U.S. PATENT DOCUMENTS

| | | | | | |
|---|---|---|---|---|---|
| 252,925 | A * | 1/1882 | Browning | A47F 7/06 | 211/33 |
| 288,287 | A * | 11/1883 | Whipple | A47F 7/06 | 211/33 |
| 366,316 | A * | 7/1887 | Haynes | A47F 7/06 | 211/33 |
| 486,654 | A * | 11/1892 | Wilson | A47F 7/06 | 211/33 |
| 561,473 | A * | 6/1896 | Bailey | A47F 7/06 | 211/33 |
| 649,883 | A * | 5/1900 | Youngs | A47F 7/06 | 211/171 |
| 702,232 | A * | 6/1902 | Moore | A47F 7/06 | 211/33 |
| 1,231,635 | A * | 7/1917 | Nelson | A47F 7/06 | 223/66 |
| 1,387,765 | A * | 8/1921 | Colonna | A47F 5/06 | 211/33 |
| 1,754,998 | A * | 4/1930 | Geartts | A47F 3/14 | 211/205 |
| 1,797,077 | A * | 3/1931 | Dew | A47G 7/041 | 248/315 |
| 1,804,931 | A * | 5/1931 | Hoban | A42C 3/04 | 211/33 |
| 2,291,877 | A * | 8/1942 | Carter | A47F 5/04 | 211/33 |

(Continued)

*Primary Examiner* — Jennifer E. Novosad

(57) ABSTRACT

A wig stand system for keeping the style and shape of wigs comprising of a base, a connector, at least one arm, and at least one wig holder having a support, a cover, at least one body member, and a storage unit; wherein the connector bridges the base and the arm; wherein the connector includes a rotating member that allows the arm to rotate with respect to a vertical axis on a horizontal plane; wherein the wig holder is configured to receive a wig; wherein the cover and the body member are configured to receive the insertion of one or more pins.

1 Claim, 5 Drawing Sheets

(56) References Cited

U.S. PATENT DOCUMENTS

D134,110 S * 10/1942 Bersin et al. ..... 211/47
2,632,570 A * 3/1953 Parks ..... A47G 25/0607 211/106.01
2,709,004 A * 5/1955 Dahlstrom ..... A47F 7/06 211/33
2,713,444 A * 7/1955 Dombrowski ..... A42B 1/002 223/25
2,794,554 A * 6/1957 Donner ..... A47G 7/042 211/163
3,198,408 A * 8/1965 Benner ..... A47F 7/065 446/268
3,300,108 A * 1/1967 Schumer ..... A45D 44/14 248/176.1
3,315,819 A * 4/1967 Kingsbery ..... A47F 5/04 211/163
3,501,072 A * 3/1970 Kovener ..... A47F 5/04 223/66
3,503,581 A * 3/1970 Rouleau ..... A45D 44/14 248/176.1
3,515,318 A * 6/1970 Preble ..... A45D 44/14 223/66
3,568,899 A * 3/1971 Rosenberg ..... A45D 44/14 269/95
3,580,436 A * 5/1971 Di Luco ..... A47F 7/065 223/66
3,602,372 A * 8/1971 Verrecchio ..... A47F 5/0853 211/100
3,603,489 A * 9/1971 Fleisher ..... A45D 44/14 223/66
3,650,441 A * 3/1972 Lindgren ..... A45D 44/14 223/66
3,741,448 A * 6/1973 Friedman ..... A45D 44/14 223/66
3,820,694 A * 6/1974 Pabis ..... A47F 7/065 248/200.1
4,470,527 A * 9/1984 Middleton ..... F16B 7/10 223/66
D351,745 S * 10/1994 Seifert ..... D6/682.6
5,423,435 A * 6/1995 Pollard ..... A47F 7/08 211/163
D361,224 S * 8/1995 Stanley ..... D6/680.3
5,765,700 A * 6/1998 Donne ..... A47F 7/0064 D6/680.3
5,833,080 A * 11/1998 Donne ..... A47F 7/0064 248/175
6,527,618 B1 * 3/2003 Faunda ..... A63H 3/44 446/394
D538,064 S * 3/2007 Schechter ..... D6/674.1
7,340,859 B2 * 3/2008 Palsrok ..... A01G 9/022 248/167
8,567,617 B1 * 10/2013 Tapager ..... A47G 23/02 211/74
D719,769 S * 12/2014 Daniels ..... D6/682.1
9,125,487 B1 * 9/2015 Gonzalez Ruiz .... A47B 61/003
9,538,831 B1 * 1/2017 Tracy ..... D06F 57/04
D842,549 S * 3/2019 Ndu ..... D28/93
10,219,605 B1 * 3/2019 Love ..... A47F 5/06
10,791,828 B1 * 10/2020 Ryan ..... A47F 5/06
D911,620 S * 2/2021 Riddick ..... D28/93
D912,905 S * 3/2021 Nnakwe ..... D28/93
11,304,498 B2 * 4/2022 Duffus ..... A47B 45/00
2005/0109367 A1 * 5/2005 Smith ..... A45D 44/14 132/333
2006/0289368 A1 * 12/2006 Abney ..... A47F 7/065 211/13.1
2009/0008347 A1 * 1/2009 Bell ..... A47F 5/02 211/183
2010/0300900 A1 * 12/2010 Quan ..... A45C 11/16 206/6.1
2013/0206709 A1 * 8/2013 Verson ..... A47F 5/0807 211/13.1
2021/0112948 A1 * 4/2021 Wachtfogel ..... A45D 44/14

* cited by examiner

WIG STAND SYSTEM AND METHOD OF USE

BACKGROUND

1. Field of the Invention

The present invention relates generally to the field of wigs, and more specifically to wig stand system and method of use for holding one or more wigs and for retaining the style and shape of the one or more wigs.

2. Description of Related Art

Wig stand systems are well known in the art and are effective means to organize and display wigs or other hair pieces when not worn. Commonly in the art, wig stand systems propose positioning wigs on mannequin heads to retain the shape of the wig as well as demonstrating what the wig would look like on a person's head.

One of the problems commonly associated with this is that a user may not like the aesthetics of using mannequin heads in wig stand systems to organize and display his or her wigs. Additionally, many wig stand systems do not provide a way for a user to retain the style and shape of the wig while on the mannequin head. What is needed is a wig stand system without uncanny aesthetics while allowing a user to retain the style and shape of a wig when not worn.

Accordingly, although great strides have been made in the area of wig stand systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1B:
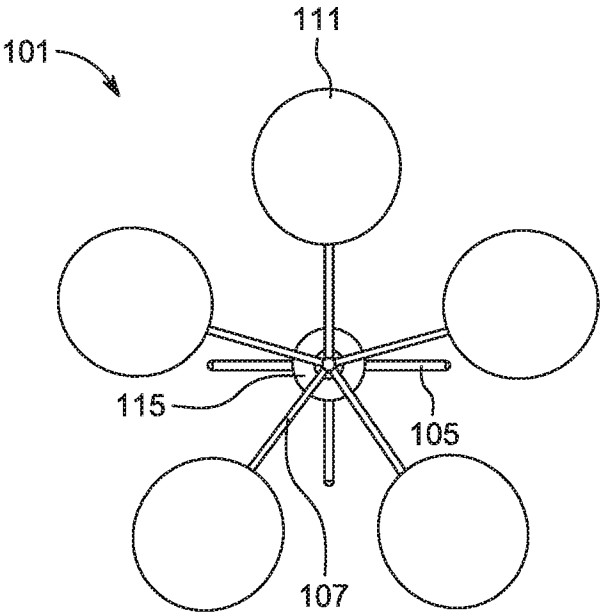
FIG. 1B is a top view of a wig stand system in accordance with a preferred embodiment of the present application.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional wig stand systems. Specifically, the system of the present invention provides a means for a user to maintain the style and shape of a wig when not worn. Additionally, the system of the present invention preserves the integrity and prolongs the lifespan of a wig. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Reference in the specification to "wig", "wigs", "hairpiece" or "hairpieces" are interchangeable and mean a head covering made from human hair, animal hair, synthetic fiber, or a combination thereof.

Figure 1A:
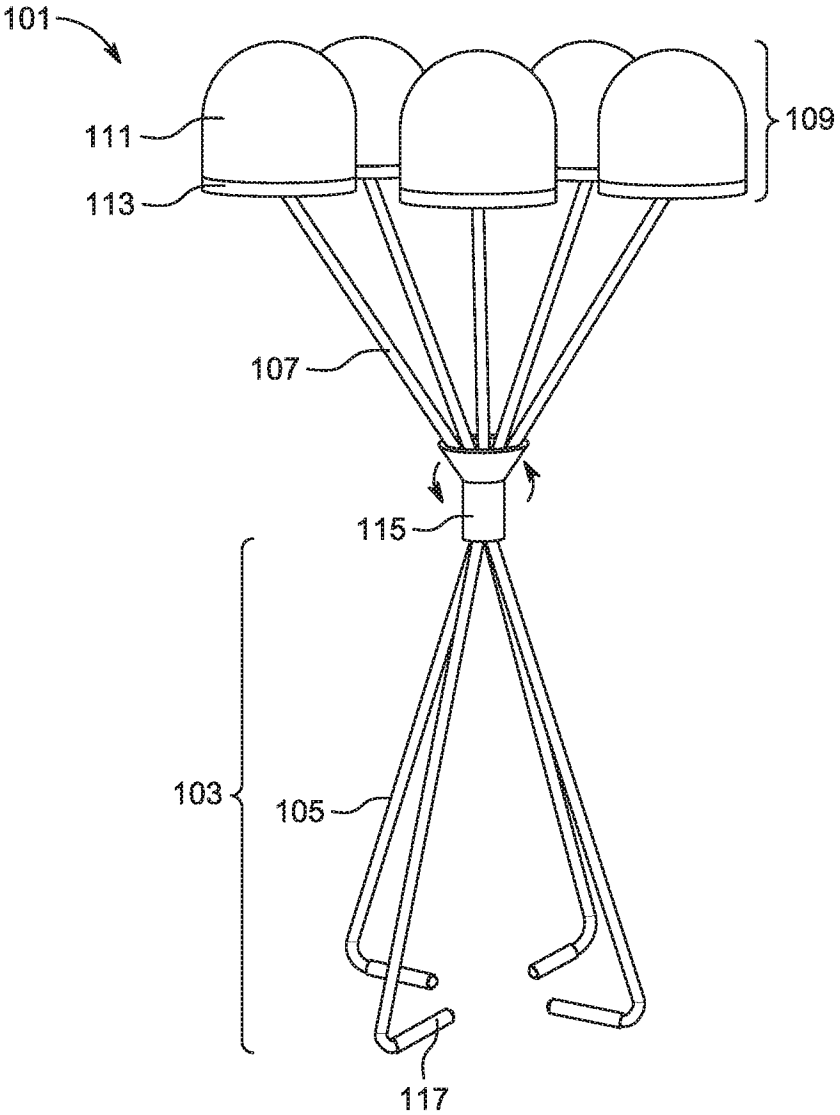
FIG. 1A is a front view of a wig stand system in accordance with a preferred embodiment of the present application.

Referring now to the drawings wherein like reference characters identify corresponding or similar elements throughout the several views, FIGS. 1A-1B depict a front view and a top view of a wig stand system 101, respectively, in accordance with a preferred embodiment of the present application. It will be appreciated that system 101 overcomes one or more of the above-listed problems commonly associated with conventional wig stand systems.

In the contemplated embodiment, system 101 includes a base 103 comprising of one or more legs 105 and one or more feet 117. The legs 105 deploy in a splayed position with the feet 117 curved inwards. The legs 105 and the feet 117 may be composed of a plurality of material such as steel, chromium, metal, plastic, wood, bamboo, or a combination thereof to support the weight of system 101, in a plurality of lengths, and in a plurality of colors, patterns, or the like to achieve the desired aesthetic. It should be appreciated that the base 103 may also comprise of other support surfaces other than legs and feet such as having a rounded or circular bottom.

Figure 2B:
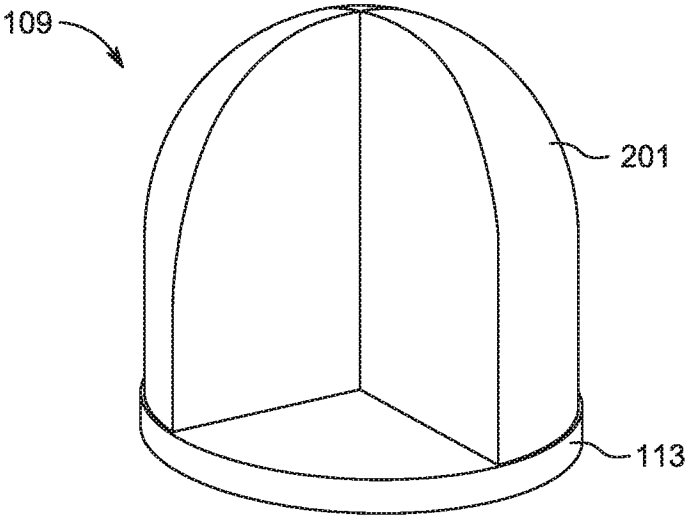
FIG. 2B is a half sectional view of a wig holder according to one or more aspects of the present application.
Figure 2A:
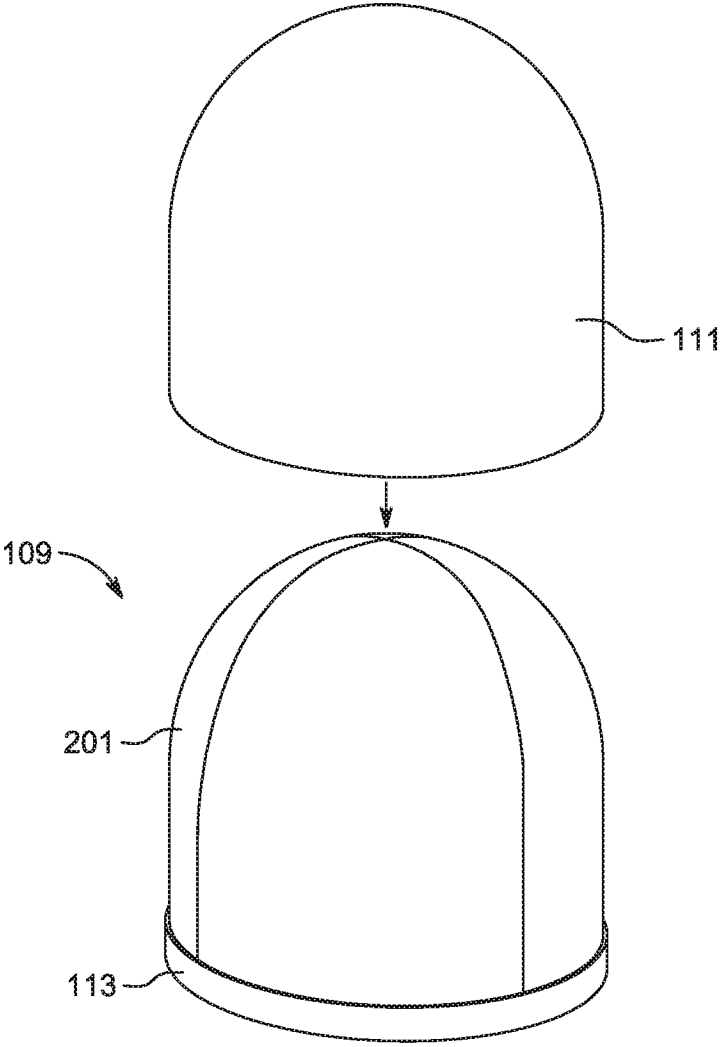
FIG. 2A is a front view of a wig holder according to one or more aspects of the present application.

System 101 also includes one or more arms 107 that each bolster a wig holder 109 comprising of a cover 111, a dome support 113, and at least one quarter piece 201 (not shown, see FIGS. 2A and 2B). The arms 107 deploy in a splayed position in a plurality of angles while bolstering the wig holder 109. The dome support 113 connects the arms 107 to the wig holder 109. It should be appreciated that the arms 107 and the dome support 113 may be composed of a plurality of material such as steel, chromium, metal, plastic, wood, bamboo, or a combination thereof to support the weight of system 101, in a plurality of lengths, and in a plurality of colors, patterns, or the like to achieve the desired aesthetic. In addition, it should be appreciated that the cover 111 comprises of elastic material such as elastane, polyether-polyurea copolymer, spandex fiber, or any other suitable material.

It is contemplated and will be appreciated that the arms 107 may be collapsible and have various user controls to manipulate the length to achieve the desired aesthetic.

System 101 further includes a connector 115 that bridges the arms 107 and the base 103. The connector 115 keeps the base 103 stationary and allows the arms 107 to rotate with respect to a vertical axis on a horizontal plane as depicted by directional arrows. It should be appreciated that the connector 115 may be composed of a plurality of material such as steel, chromium, metal, plastic, wood, bamboo, or a combination thereof to support the weight of system 101, in a plurality of lengths, and in a plurality of colors, patterns, or the like to achieve the desired aesthetic.

It is further contemplated and will be appreciated that system 101 may incorporate a storage unit (not shown) configured to hold and store objects including, but not limited to, pins, hair accessories, and the like. It should be appreciated that the storage unit may be composed of a plurality of material such as steel, chromium, metal, plastic, wood, bamboo, or a combination thereof to support the weight of system 101, in a plurality of lengths, and in a plurality of colors, patterns, or the like to achieve the desired aesthetic.

Referring now to FIGS. 2A and 2B, a front view and a half sectional view of a wig holder 109, respectively, are shown in accordance with one or more aspects of the present application. The wig holder 109 comprises of four quarter pieces 201 that are wedge shaped and that when positioned together creates a dome-shape on the dome support 113. It should be appreciated that the quarter pieces 201 are comprised of foam material (e.g., polyurethane) having a plurality of densities and a plurality of durometer values. It should also be appreciated that the quarter pieces 201 are equal in size, shape, weight with each other.

It is contemplated and will be appreciated that the quarter pieces 201 may be any shape or form that can create a dome-shape when coupled with one or more other quarter pieces 201. Furthermore, it is contemplated and will be appreciated that the quarter pieces 201 may comprise of a singular body that forms a dome-shape.

Figure 3:
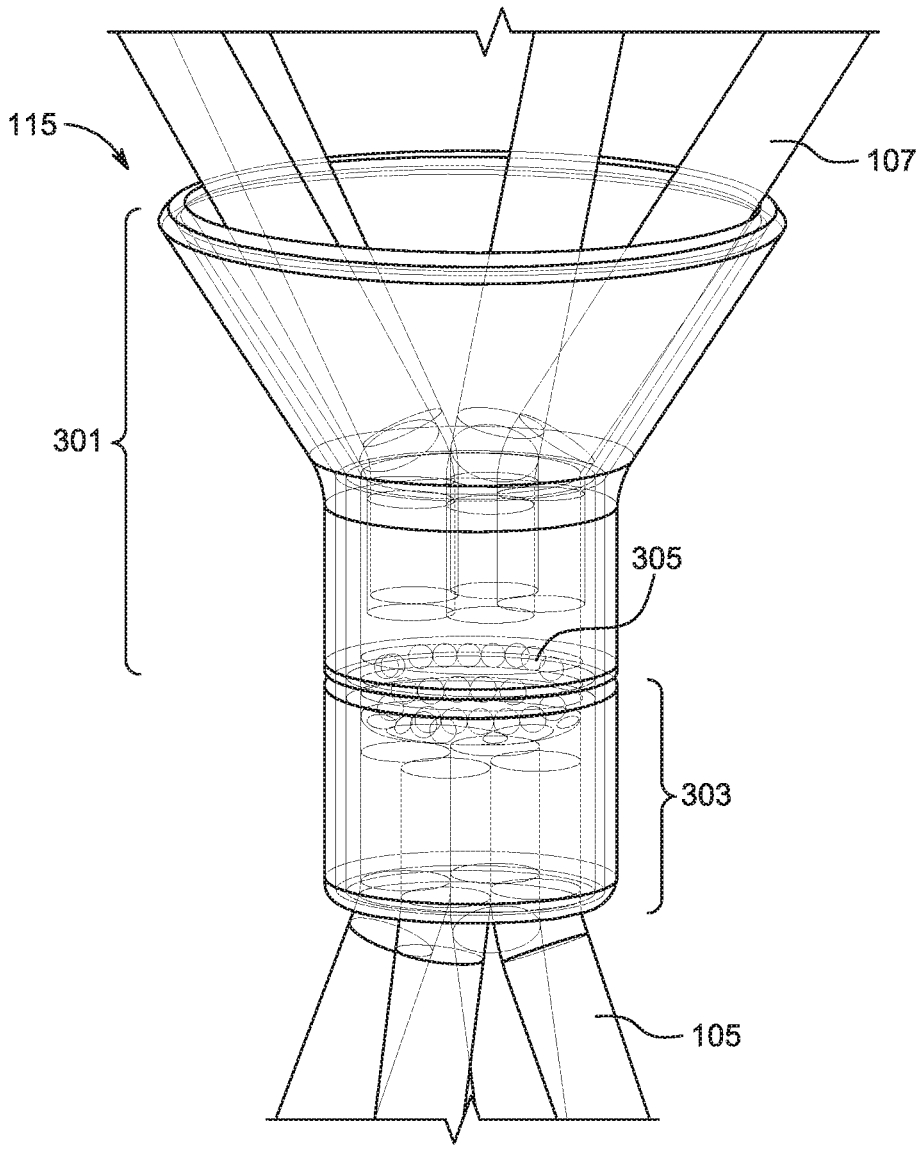
FIG. 3 is a cross-sectional view of a connector according to one or more aspects of the present application.

In FIG. 3, a cross-sectional view of a connector 115 in accordance with one or more aspects of the present application is shown. The connector 115 comprises of a top portion 301 and a bottom portion 303 that attach via a swivel joint 305. The swivel joint 305 keeps the bottom portion 303 stationary while allowing the top portion 301 to rotate the arms 107 with respect to a vertical axis on a horizontal plane.

It is contemplated and will be appreciated that the swivel joint 305 may incorporate ball bearings. Furthermore, it is contemplated and will be appreciated that the swivel joint 305 can be straight-through, right-angle, and offset.

Figure 4:
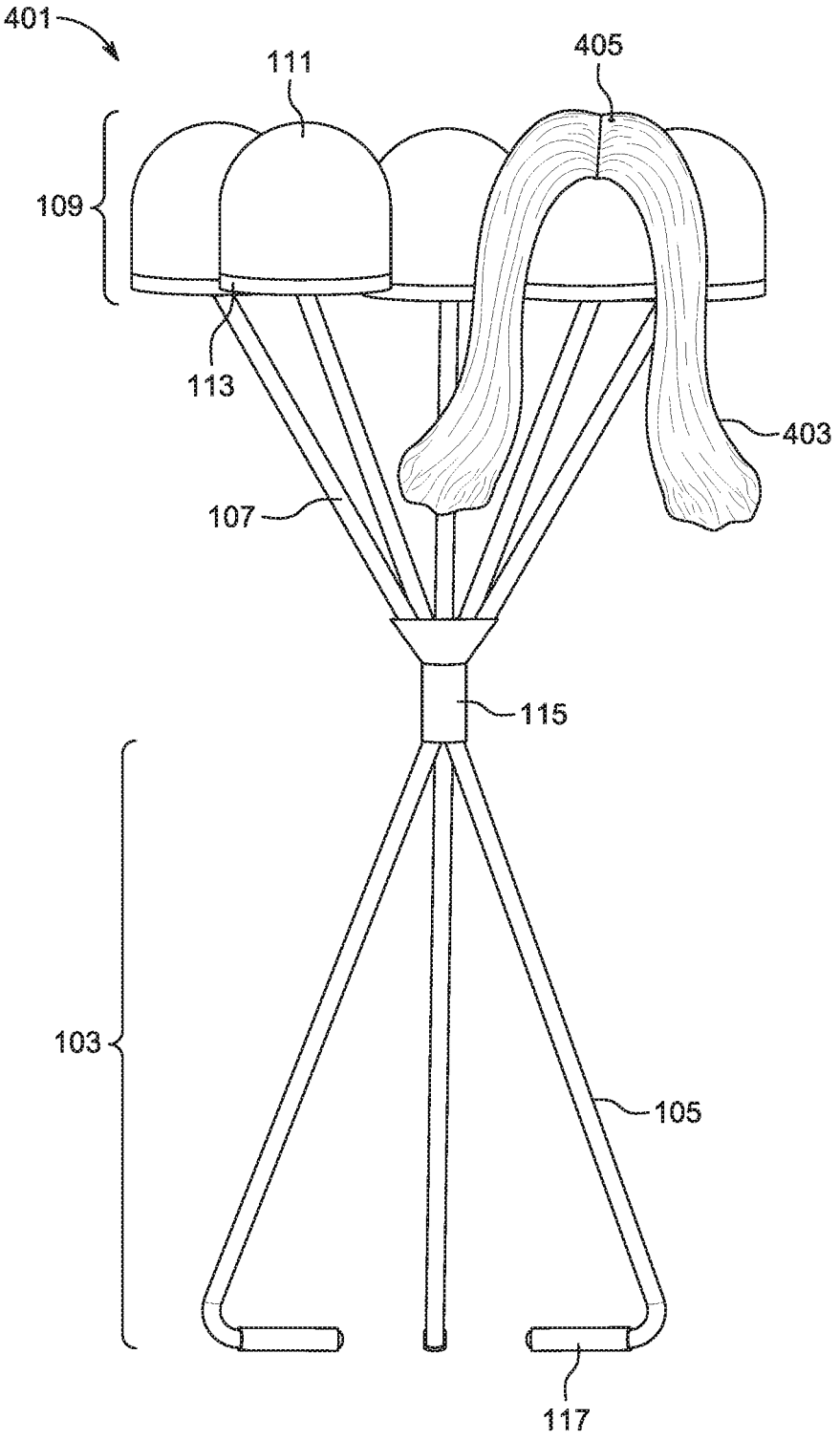
FIG. 4 is a front view of a wig stand system in use in accordance with an embodiment of the present application.

FIG. 4 is a front view of a wig stand system 401 in use in accordance with an embodiment of the present application. As shown, a wig 403 may be placed over the cover 111 of a wig holder 109. A user may insert one or more pins 405 through the wig 403 and into the wig holder 109 to retain the desired shape and style. It should be appreciated that the one or more pins 405 may be any shape or form including, but not limited to, t-pins, wig blocking pins, glass head pins, and hair pins.

It should also be appreciated that one of the unique features believed characteristic of the present application are the quarter pieces 201. It should be understood that this feature allows a user to secure a wig 403 via one or more pins 405 into the quarter pieces 201 to achieve the desired style and shape. In addition, the quarter pieces 201 allow a user to organize and display hairpieces aesthetically without the use of mannequin heads.

Figure 5:
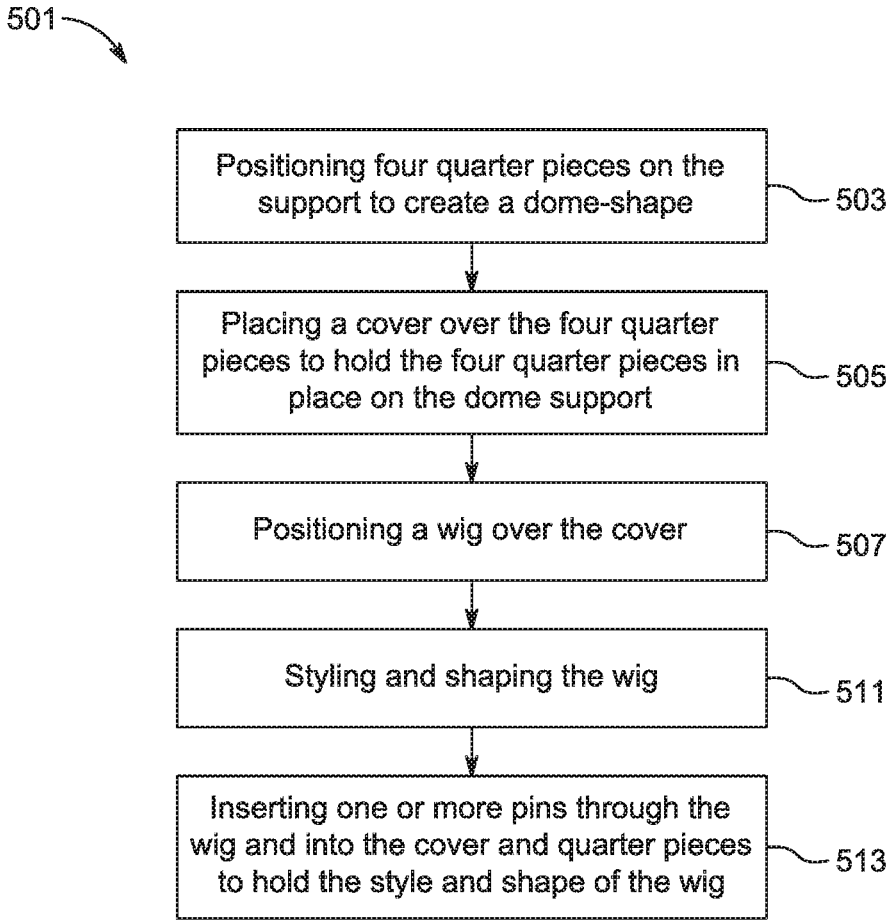
FIG. 5 is a flowchart of the method of use of the wig stand system according to one or more aspects of the present application.

FIG. 5 is a flowchart of the method of use 501 of the wig stand system according to one or more aspects of the present application. Four quarter pieces are positioned on the dome support to create a dome-shape and a cover is placed over the four quarter pieces to hold the four quarter pieces in place on the dome support, as seen with boxes 503, 505. A wig may be positioned over the cover and a user may style and shape the wig, as shown with boxes 507, 509. The user may insert one or more pins through the wig and into the cover and quarter pieces to hold the style and shape of the wig, as shown with box 511.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A wig stand system for holding and retaining style and shape of wigs, comprising:

a top portion;

a bottom portion having:

one or more legs; and one or more feet secured to the one or more legs;

a connector having a swivel joint, the top portion rotates relative to the bottom portion via the swivel joint;

at least one arm secured to the top portion;

at least one wig holder secured to the at least one arm, the at least one wig holder forming a dome-shaped support, the at least one wig holder has four separate quarters that when combined together form a dome-shape configuration; and a cover that fits over the at least one wig holder;

wherein the connector bridges the bottom portion with the top portion; and wherein the wig holder is configured to receive a wig.

* * * * *